US005373216A

United States Patent [19]

Dakin et al.

[11] Patent Number: 5,373,216

[45] Date of Patent: Dec. 13, 1994

[54] ELECTRODELESS ARC TUBE WITH STABILIZED CONDENSATE LOCATION

[75] Inventors: James T. Dakin; Mark E. Duffy, both of Shaker Heights, Ohio

[73] Assignee: General Electric Company, Schenectady, N.Y.

[21] Appl. No.: 992,324

[22] Filed: Dec. 21, 1992

[51] Int. Cl.[5] ..... H05B 41/24

[52] U.S. Cl. ..... 315/248; 315/344; 313/573; 313/234; 313/607; 313/638

[58] Field of Search ..... 315/248, 39, 267, 344, 315/348; 313/572, 573, 607, 634, 636, 637, 638, 234

[56] References Cited

U.S. PATENT DOCUMENTS

| | | | |
|---|---|---|---|
| 4,095,142 | 6/1978 | Murayama et al. | 315/248 |
| 4,783,615 | 11/1988 | Dakin | 315/248 |
| 5,021,704 | 6/1991 | Walker et al. | 315/248 X |
| 5,150,015 | 9/1992 | Heindl et al. | 315/248 |
| 5,151,633 | 9/1992 | Farrall et al. | 315/248 |
| 5,157,306 | 10/1992 | Witting | 315/248 |

*Primary Examiner*—David Mis

*Attorney, Agent, or Firm*—George E. Hawranko; Stanley C. Corwin

[57] ABSTRACT

An electrodeless high intensity discharge (HID) lamp arc tube having a stabilized condensate location. The arc tube contains a predetermined location or distortion on the inside surface of the arc tube. The distortion may be a protrusion on the inside surface of the arc tube formed during the arc tube forming process. In operation of the lamp, the non gaseous dose remains condensed substantially in the cold spot region formed by said protrusion so that the arc tube walls remain clear for maximal light output, and the arc tube remains stable and efficacious to substantially higher power than is the case for arc tubes without the distortion.

20 Claims, 2 Drawing Sheets

ELECTRODELESS ARC TUBE WITH STABILIZED CONDENSATE LOCATION

FIELD OF THE INVENTION

This invention relates generally to electrodeless high intensity discharge (HID) lamps, and more particularly to an electrodeless HID lamp arc tube with a fixed condensate location for a stabilized arc discharge and improved luminous efficacy of the lamp.

BACKGROUND OF THE INVENTION

High Intensity Discharge lamps are widely used in a number of commercial and industrial settings such as high bay industrial areas, lobbies and gyms among other applications. HID lamps are desirable for these applications because of their ability to provide light output with a high degree of luminous efficacy measured in lumens per watt (LPW) and an acceptable color rendering index (CRI). The arc tube of an HID lamp generally contains a fill of an ionizable gas. The fill normally constitutes a rare gas, a charge of mercury and one or more of the metal halides. During operation of a typical HID lamp, an arc discharge is established by passing a current through a pair of electrodes disposed within the arc tube containing the fill. In the arc discharge the metal halide dissociates, metal ions are thermally excited to higher energy states, and these excited atoms radiate their characteristic wavelengths. In response to the fact that such electrodes may be subject to energy loss, evaporation and chemical attack by the gas constituents of the arc tube, recent design efforts have been directed along the lines of removing the electrodes altogether.

Metal halide arc discharge lamps of this type of lamp are shown, for example, in U.S. Pat. Nos. 4,972,120; 4,810,938; 4,871,946; 4,894,589; and 4,894,590, all assigned to the assignee of the present invention and are hereby incorporated by reference. A prior art electrodeless HID lamp is described in U.S. patent application Ser. No. 07/685,371 filed on Apr. 15, 1991 for an Electrodeless High Intensity Discharge Lamp Having an Integral Quartz Outer Jacket and assigned to the same assignee as the present invention. Such an HID electrodeless lamp includes an outer envelope encasing an arc tube containing a fill of an ionizable gas capable of forming a light emitting plasma. The HID lamp further includes a solenoidal coil disposed around the outer envelope and in proximate relation to the enclosed arc tube for coupling of RF energy from an RF energy excitation source to the arc tube to ionize the fill.

As described in the previously noted U.S. patent application Ser. No. 07/685,371, the arc tube has a probe, also made of the same fused quartz material as the arc tube. The probe extends from the central portion on the surface of the upper hemisphere of the arc tube and acts as a starting aid for the lamp and as a support for the arc tube within the outer jacket. The arc tube shape is chosen so as to minimize temperature gradients around the arc tube. The outer jacket is disposed in surrounding relation to a large portion of the arc tube in such a manner as to allow for efficient thermal management of heat generated by the arc tube enclosed within the outer jacket. As described in U.S. Pat. No. 4,972,120, issued to Witting and assigned to the same assignee as the present invention, the fill contained inside the arctube generally includes volatile condensate and constituent gases which will preferably include one or more metal halides and a buffer gas which is typically an inert gas such as krypton or xenon. The fill is introduced into the arc tube through an exhaust tubing connected to the arc tube, after which it is then tipped off by heating to leave a small projection or exhaust tip-off on the surface of the arc tube in place of the exhaust tubing. The fill constituents are combined in proper weight proportions so as to achieve the desirable efficacy and color temperature characteristics of the discharge arc which will be generally toroidal in shape.

The temperature of the arc discharge ranges from a low value on the order of 900–1000K at the arc tube wall to approximately 5000K at the plasma center so that the high temperature becomes localized at the center of the discharge, there being a temperature gradient towards the walls of the arc tube and the central portion of the toroidal discharge, which are much cooler. As a consequence of this temperature gradient the arc discharge may become constricted. Another factor that contributes to the constriction of the arc discharge is chemical reactions of the metal halides that occur near the walls of the arc tube. Discussion of the chemical reactions will be mentioned in more detail hereinafter. Due to its constricted shape, the arc discharge is capable of moving around inside the arc tube since the arc tube walls are not effective in stabilizing it. Hence the arc discharge in such an electrodeless HID lamp is particularly prone to instability by virtue of the plasma having room to move around inside the arc tube. Any other factors that will contribute to the instability of the arc discharge inside the arc tube would be therefore highly undesirable. Such instability will cause the lamp to flicker and will render the lamp useless as a stable light source.

One mechanism that has been associated with the instability of the arc discharge of an electrodeless HID lamp such as that of the previously noted U.S. patent application Ser. No. 07/685,371 is movement of the condensate fill on the inside walls of the arc tube during lamp operation. In this lamp, high temperatures above 900K are required on the arc tube walls to prevent the fill material from condensing on the arc tube walls. The condensate has a natural tendency to settle around the equatorial portion of the oblate spheroidal arc tube. When a certain location on the inside surface of the arc tube is cooler than the rest of the surface, the fill material will condense at that particular location. Condensation of the fill material on the arc tube surface acts to block some light output from the arc tube walls resulting in reduced luminous efficacy of the lamp. Once condensed at the cold spot any motion of the discharge toward the cold spot will vaporize the condensate. Consequently the cold spot moves to another location of the arc tube walls where the condensate will move to. This cycle continues, causing instability of the arc discharge as the condensate moves from one cold spot location to another resulting in flickering and eventually extinction of the light source.

It would be desirable to solve the above mentioned issues relating to motion of the condensate location and light blockage from the arc tube by the condensate in order to achieve a more stable and efficacious light source. In particular it would be advantageous to eliminate the above-mentioned feedback mechanism responsible for movement of the condensate location and therefore arc discharge instability. It would also be beneficial to achieve such a stabilized light source in a manner that does not allow the condensed fill material to block a substantial amount of the light output through the arctube walls.

It is the object of this invention to provide an electrodeless arc tube with a fixed condensate location which does not change when the arc discharge location changes and to do so in a practical manner. Fixing the condensate location is intended to remove the above-described feedback mechanism partially responsible for discharge instability and to minimize the light output blocked by the condensate on the arc tube wall.

SUMMARY OF THE INVENTION

The present invention provides an electrodeless HID lamp arc tube with a fixed condensate location for improved stability of the arc discharge and increased luminous efficacy of the lamp. Movement of the condensate location on the inside surface of the arc tube during lamp operation is partially responsible for the instability of the arc discharge that will cause the light source to flicker and even extinguish. Deposition of the condensate on the arc tube walls also blocks some light output from the lamp. To avoid problems such as these, an arc tube is provided for an electrodeless HID lamp with a distortion on the inside surface of the arctube to provide a cold spot where the condensate location is fixed to stabilize the light source and to obtain maximal release of light output through the arc tube walls.

In accordance with the principles of the present invention, electrodeless HID lamp includes an arc tube containing a fill. The arc tube is preferably an oblate spheroidal shape, made out of a high temperature light transmissive material such as fused quartz. The arc tube may contain a fill of at least one or more metal halides and a rare gas to act as a buffer gas. Most preferably the arc tube contains a combination of at least one metal halide selected from among iodides of sodium, neodymium, or cerium and an inert gas such as xenon or krypton. Upon energization by means of a high frequency RF signal, the ionizable gas is excited into a gas discharge thereby emitting visible light. An outer jacket encloses the arc tube in such a manner as to provide efficient thermal management in the space between the outer jacket and the arc tube disposed therein. A probe, made of the same material as the arc tube and connecting the arc tube to the outer jacket, serves as a starting aid for the lamp and a support for the arc tube within the outer jacket. The starting aid is of substantially smaller diameter than the arc tube. An excitation coil is wound around the exterior of the outer jacket proximate to the arc tube enclosed therein for coupling of RF energy from the excitation circuitry to the arc tube.

The arc tube of the present invention is constructed to contain a depression on the inside surface of the arc tube at the tip-off by deliberately making the exhaust tip-off long, contrary to conventional arc tube forming practice. The depression, located at the central portion of the inside surface of the lower hemisphere of the oblate spheroidal arc tube, remains colder than the rest of the inside surface of the arc tube causing the fill material to condense at that fixed cold spot location. During operation of the lamp, the fill materials remain in this cold spot region, the arc tube walls remain clear for maximal light output, and the arc tube remains stable and efficacious to substantially higher power than the case of short-tipped arc tubes.

BRIEF DESCRIPTION OF THE PREFERRED EMBODIMENTS

DETAILED DESCRIPTION OF THE PREFERRED EMBODIMENT

Figure 1:
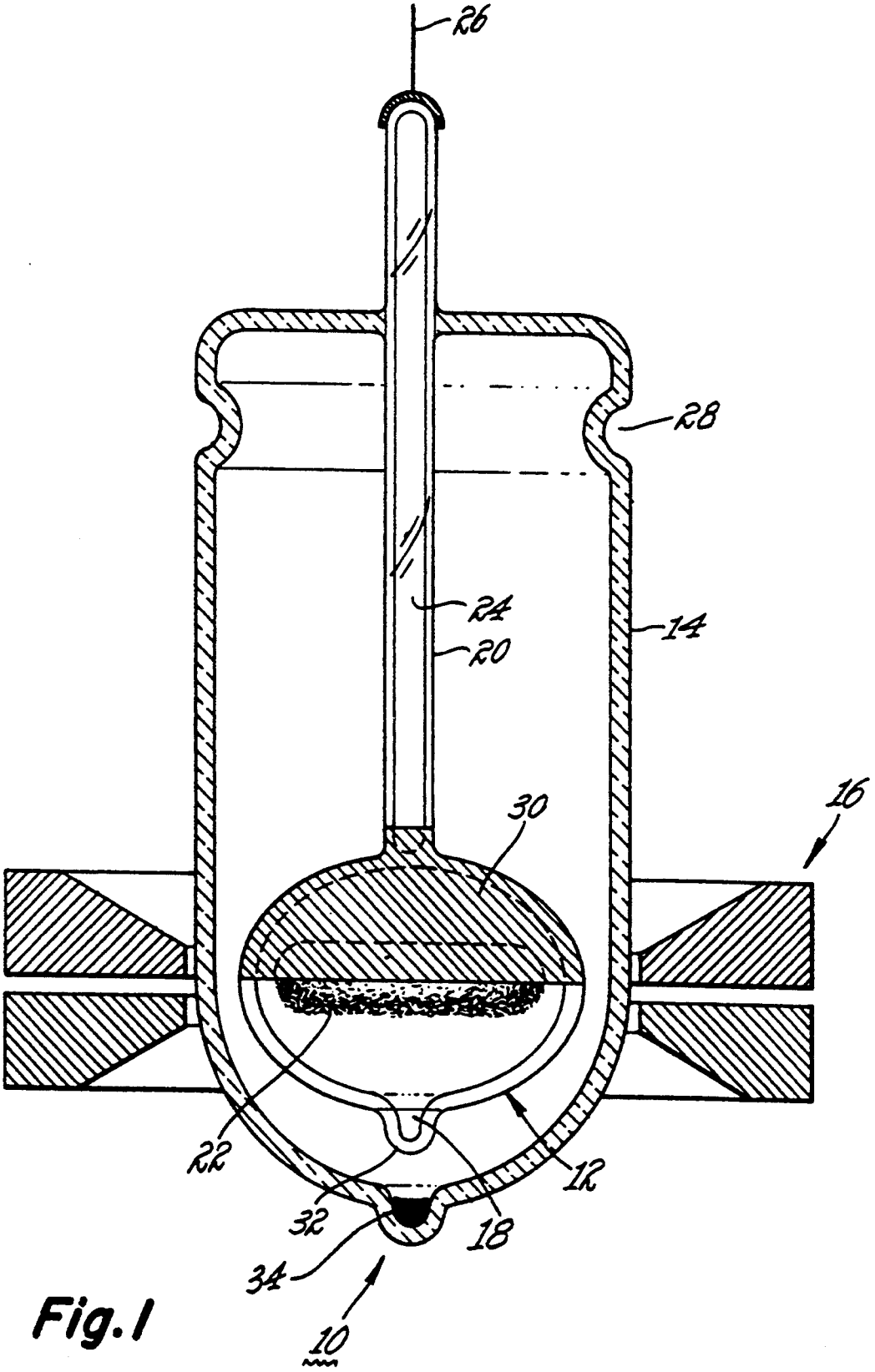
FIG. 1 is an elevational view in cross-section of an electrodeless HID lamp with an arc tube constructed in accordance with the present invention.

FIG. 1 shows an inductively-driven electrodeless HID lamp 10 of the present invention comprising an oblate spheroidally shaped arc tube 12 with a fill disposed therein, an outer envelope 14 disposed around the arc tube 12, and a solenoidal coil 16 forming a portion of the energizing member disposed around the outer envelope for coupling RF energy from an excitation source (not shown) to the arc tube 12 thereby forming a light emitting gas discharge 22 within the arc tube 12. The arc tube 12 of the present invention has a depression 18 on the inside surface of the arc tube 12 that provides a predetermined location or cold spot where condensate material within the arc tube will settle during lamp operation. Fixing the cold spot location prevents the motion of the condensate inside the arctube that is partially responsible for the instability of the arc discharge 22 within the arc tube 12. A starting aid 20 for the lamp 10 supports the arc tube 12 within the outer jacket.

In operation, the excitation source, in this case an RF power supply, provides a current to the solenoidal coil 16 disposed around the outer jacket 14 proximate to the arc tube 12 which results in a changing magnetic field. The changing magnetic field will produce an electric field within the arc tube which substantially closes upon itself. As a result of the solenoidal electric field current flows through the fill within the arc tube 12 to produce a toroidal arc discharge 22 within the arc tube 12. The arc tube 12 may be coated with a reflective coating 30 that covers the outer surface of the upper hemisphere of the arc tube 12 so that light emitted by the toroidal discharge 22 is projected through the lower hemisphere of the arc tube 12. The solenoidal coil 16 is designed so as to block the minimal amount of light output from the toroidally shaped arc discharge 22 within the arc tube 12. Suitable operating frequencies for the RF power supply are in the range of 1 megahertz to 300 megahertz with a preferred value of 13.56 megahertz. The starting aid 20 is a tubular member which is substantially smaller in diameter than the arc tube 12 and extends from the upper hemisphere of the arc tube 12. The starting aid 20 has a hollow center 24 containing a gaseous media and serves as a means for initiating the electric discharge within the arc tube 12. A more detailed description of the configuration and operation of the starting probe is given in U.S. patent application Ser. No. 07/787,158 filed on Nov. 4, 1991 for a Luminaire Including an Electrodeless Discharge Lamp as a Light Source and assigned to the same assignee as the present invention. The outer jacket 14 is made of the same fused quartz material as the starting aid 20 and is shaped so as to conform substantially to the form of the lower hemisphere of the oblate spheroidal shaped arc tube 12. An electrical contact 26 from a starting excitation source (not shown) is coupled to the starting aid 20. A minimum spacing between the arc tube 12 and the lower portion of the outer jacket 14 is effective for efficient coupling of the RF energy from the solenoidal coil 16 to the arc tube 12. The spacing above the arc tube allows for the length of the starting aid 20 and is also effective in providing a thermal management of heat within the outer jacket 14 whereby the thermal losses from the arc tube 12 as caused by heat convection and/or conduction and/or radiation can be controlled within the outer jacket 14. The annular groove 28 in the external upper portion of the outer jacket 14 accommodates means for securing the outer jacket 14 to a lighting fixture.

Figure 2:
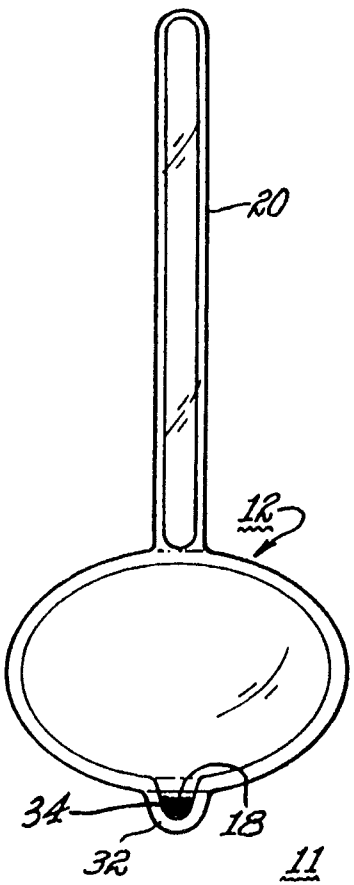
FIG. 2 is an elevational view in cross-section of the preferred embodiment of an arc tube for an electrodeless HID lamp constructed with a cold spot protrusion in accordance with the present invention.

The oblate spheroidal shaped arc tube 12 of the present invention is designed to minimize temperature gradients around the arctube 12, that is, this shape provides for a cold spot temperature required for adequate halide vapor pressures, and a minimum hot spot temperature which ensures long life. For a more detailed discussion of the shape characteristics of the arctube 12, reference is hereby made to the previously noted U.S. Pat. No. 4,810,938 which is incorporated herein by reference. The arc tube 12 is preferably constructed of a high temperature glass material such as fused quartz or alternatively, an optically transmissive ceramic such as polycrystalline alumina. The arc tube 12 is constructed by blow molding a small section of a small diameter quartz tubing to obtain an oblate spheroidal chamber with two small diameter tubular legs. One tubular leg is removed and the arc tube sealed to allow for the attachment of the hereinabove described starting aid 20. The other tubular leg is left to serve as an exhaust tubing effective for introducing the fill into the arc tube 12 after which it is sealed or tipped-off close to the arc tube 12 surface. In the embodiment of the present invention shown in FIG. 2 the cold spot depression 18 is formed by heating the exhaust tubing near the arc tube 12 surface and tipping off the exhaust tubing so that the exhaust tip-off 32 is longer than for conventional metal halide lamps. In this manner the depth of the protrusion 18 can be controlled by the length of the tip-off 32 made during the tip-off process.

The arc tube 12 contains a fill of volatile condensate and constituent gases which preferably includes a combination of one or more metal halides and a buffer gas which is typically an inert gas such as krypton or xenon. The fill constituents are combined in proper weight proportions to achieve the desirable efficacy and color temperature characteristics of the gas discharge which will be generally toroidal in shape. During operation, the temperature inside the arc tube varies from about 900–1000K at the arc tube 12 wall to about 5000K at the plasma center. High temperatures of approximately 900–1000K are required on the inside walls of the arc tube 12 to provide adequate metal halide vapor pressure. During lamp operation an equilibrium is established between the metal halide molecules condensed at the arc tube wall and the atomic species in the arc discharge. At the lowest temperatures, corresponding to the vicinity of the arc tube walls, the dominant species are metal halide molecules. At intermediate temperatures the metal halide molecules are mostly dissociated, and the dominant species are monatomic. At the highest temperatures corresponding to the centers of the discharge the atomic species are ionized and the plasma contour electrons. This ionized portion of the plasma forms the substantially toroidal arc discharge. Some of the metals in the arc tube will react with the quartz arc tube walls to produce free halides. As described in Electric Discharge Lamps by John F. Waymouth, M.I.T. Press, 1971, pp. 266–267, in an HID lamp containing a sodium iodide fill, the dissociated sodium atoms may react chemically at the arc tube wall or diffuse through the walls. As more and more sodium atoms are lost, the light output decreases with the changing composition of the fill, and there is also a buildup of free iodine that may lead to arc instability and eventual extinction of the arc discharge.

Enough fill material is introduced into the arc tube 12 so that at the operating temperatures and pressures of the lamp, only a portion of the fill in the proportions required to achieve the desired efficacy and color temperature is vaporized while the rest of the metal halide fill remains condensed on the inside walls of the arc tube 12. Typically a total of about 5 to 50 mg of the fill material is dosed into an arc tube 12 with dimensions as will be given hereinafter. During operation of the lamp approximately one-fourth of a milligram of the fill material is in the vapor state while the rest remains as condensate on the arc tube walls. In order to reduce the tendency of the fill material that is present as a condensate during lamp operation to move around within the arc tube and cause instability of the light source it would be advantageous to reduce the total amount of fill material to a value less than the 5 to 50 mg range. The mechanism of the dose motion will be described hereinafter in further detail. However, the problem with reducing the amount of fill material is that chemical reactions, described hereinabove, occur within the arc tube resulting in loss of the fill material from within the arc tube. Consequently, this loss of fill material would have a proportionally larger impact on the composition of the fill material and would change the weight proportions of the constituent materials in the fill from that required to achieve the desired efficacy and color temperature of the light source.

Since a certain level of fill material must be maintained within the arc tube 12 for satisfactory lamp performance, the tendency of the arc discharge 22 to move around inside the arc tube presents the problem of lamp instability. The arc discharge motion is confounded by the observed tendency of the condensate metal halide species to move from one cold spot to another on the inside surface of the arc tube 12. The metal halide fill has a tendency during operation of the lamp to condense around the equator of the arc tube 12 as well as other locations on the inside surface of the arc tube where the temperature is coolest. Any motion of the plasma towards the condensed metal halide species located at a particular cold spot on the inside surface of the arc tube 12 will volatilize the metal halide species, thus effecting motion of the cold spot to another location of the arctube where the metal halide condensate will subsequently condense. Such a feedback mechanism will repeat itself causing the arc discharge lamp to flicker and eventually extinguish. The metal halide species condensed on the inside surface of the arc tube wall will also block some light output from the toroidal arc discharge and cause a reduction in the luminous efficacy of the lamp. In order for the lamp to be commercially acceptable to the customer the lamp should be capable of providing a more stable light source at an acceptable luminous efficacy.

According to the principles of the present invention the arc tube 12 wall for an electrodeless HID lamp is thermally engineered so as to provide a fixed cold spot location, thereby stabilizing the condensate location and therefore the arc discharge. The arctube 12 of the present invention may consist of a distortion on the surface of the oblate spheroidal arc tube 12. As viewed from the outer surface of the arc tube 12 the distortion is a protrusion or a ridge. As viewed from the inside the distortion is a depression or groove. The metal halides condense in the groove because it is the coldest location on the interior of the arc tube. It must be appreciated at this time that the present invention is not limited only to a distortion on the arc tube surface but may also be practiced using other means capable of providing a localized cold spot on the arc tube surface. For instance, by selectively cooling a certain portion of the arc tube surface to provide a localized cold spot inside the arctube.

According to the principles of the present invention the arc tube 12 of the preferred embodiment of the invention contains a depression 18 constructed into the arc tube 12 by deliberately making the exhaust tip-off 32 long, contrary to conventional metal halide practice. In operation the metal halides 34 remain condensed in this cold spot region and the arc tube walls remain clear for maximal light release, and the arc tube remains stable and efficacious to substantially higher power than is the case for short-tipped arc tubes.

The best evidence for the benefit of the invention comes from direct comparison of performance of arc tube with and without the stabilized condensate location. For the embodiment of the present invention shown in FIG. 1 arc tubes were constructed and built into lamps. All the arc tubes 12 considered here are oblate spheroids with external diameters of 26 mm and heights of 19 mm. The quartz wall thickness is 1 min. The arc tubes 12 are dosed with 48 mg of a mixture of sodium iodide (Nail and neodymium iodide (Ndl3) with a molar ratio of Na:Nd=5:1. Before sealing, the arc tubes 12 are filled with 250 torr krypton. The arc tubes 12 are attached to upwardly extending quartz starting probes 20 with external diameter of 7 mm. The arc tubes 12 have alumina reflective coatings 30 on their first or upward exterior hemispherical surfaces. The reflective coatings 30 directs the light output through the second or lower hemisphere of the arc tube. The arc tubes are mounted in outer jackets 14 filled with 500 Torr nitrogen. One group of the arc tubes have an exhaust tip-off 32 which extends 8 mm beyond the external surface of the arc tube 12 so as to provide a cold spot depression 18.

Photometry data on the two groups of arc tubes, one with and the other without the cold spot depression 18 is presented in the following table.

| Tip-Off Length | 0 mm | 8 mm |
|---|---|---|
| Power Into Coil (Watts) | Lumens | |
| 143 | 9587 | 7622 |
| 190 | 16817 | 14261 |
| 238 | 23817 | 22521 |
| 285 | unstable | 30584 |
| 333 | unstable | 37691 |
| 380 | unstable | 44981 |

-continued

| Tip-Off Length | 0 mm | 8 mm |
|---|---|---|
| Power Into Coil (Watts) | Lumens | |
| 428 | unstable | 51080 |
| 475 | unstable | 57401 |
| instability threshold | 280 W | >500 W |
| maximum efficacy | 95 Im/W | 121 Im/W |

The arc tubes with the 8 mm exhaust tip-off are seen to operate stably to higher power and to achieve higher maximum efficacy than the arc tubes without the 8 mm exhaust tip-off. Additionally, in the arc tubes with the 8 mm exhaust tip-off, the halides were observed to reside primarily in the cold spot depression 18.

Figure 4:
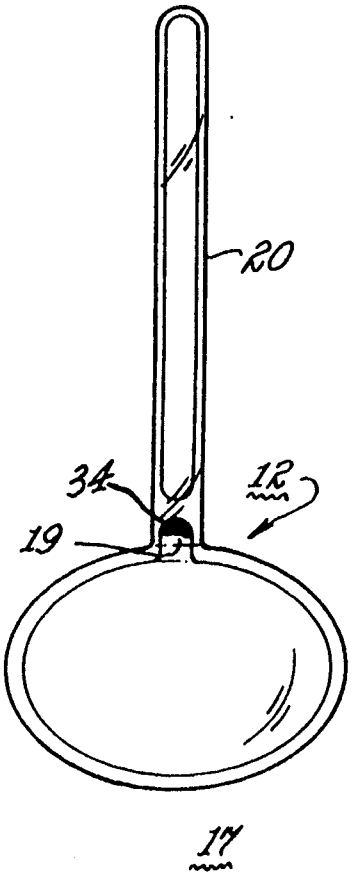
FIG. 4 is an elevational view in cross-section of an arc tube for an electrodeless HID lamp constructed with a cold spot protrusion in accordance with an alternate embodiment of the present invention.
Figure 3:
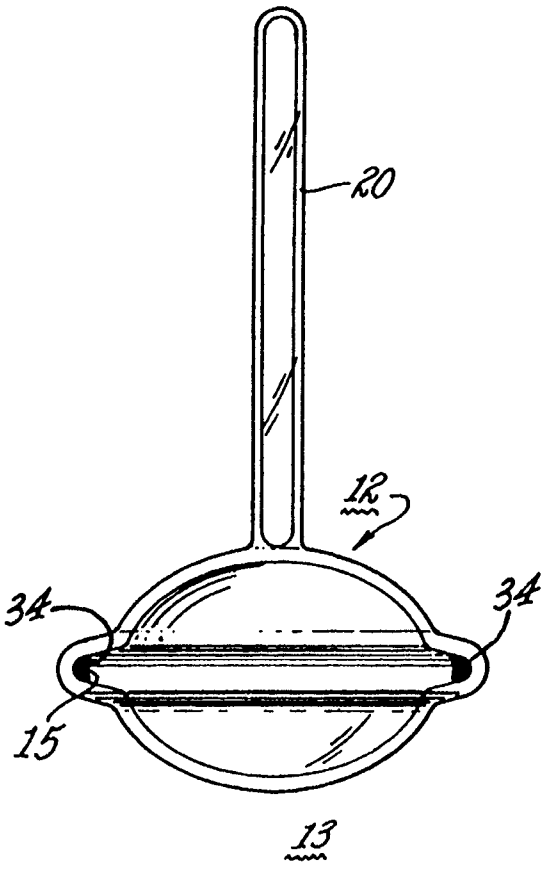
FIG. 3 is an elevational view in cross-section of an arc tube for an electrodeless HID lamp constructed with a circumferential cold spot protrusion in accordance with a second alternate embodiment of the present invention.

The described embodiment of the invention is only considered to be preferred and illustrative of the inventive concept. The invention may be practiced in various and numerous ways that may be devised by one skilled in the art without departing from the spirit and scope of the present invention. For instance, rather than an elongated exhaust tip-off the invention could also consist of one or more local distortions on the arc tube surface. If the arc tube is of blow molded quartz construction the distortion can be provided via a protrusion or a groove in the interior surface of the mold. Since cold spots tend to be around the equator of such an ellipsoidal arc tube, an equatorial groove 15 as shown in the embodiment of FIG. 3 would serve to further stabilize the cold spot at its natural location, but at the expense of some light blockage at the groove. The equatorial groove 15 of FIG. 3 extends around the full circumference of the arc tube 12. The external ridge associated with equatorial groove 15 would provide a reference point for the edge of the external reflective alumina coating applied to the upper hemisphere of the arc tube for directional release of light output. In yet another embodiment 17 of the present invention the cold spot could be a depression 19 located in the region of contact between the gas probe 20 and the wall of the arc tube 12 as shown in FIG. 4. The following is an alternative approach that was demonstrated to improve the stability of the lamp by providing a localized cold spot on the arc tube in accordance with the principles of the present invention. In these experiments, a jet of nitrogen gas was directed at the bottom of an arctube, which was generally unstable when operating at 300 W. Application of nitrogen was found to stabilize the arc discharge and move the dose from the top of the arc tube to the bottom of the arc tube and a reading on a light detector was noted to increase by 3%. Subsequent removal of the nitrogen jet reversed all of these effects, returning the arc tube to its initial, unstable condition. Of course it can be appreciated that other approaches to creating a localized condensate location may be practiced without departing from the scope of the present invention. For instance, heat sinking means could be applied to the external surface of the arctube so as to reduce the temperature on the adjacent interior surface. This could be accomplished with a quartz cooling fin, or by thermal contact with an outer jacket. In another approach cooling of a selected spot on the outer wall could be accomplished with convection.

It is understood that various modifications will be apparent to and can be readily made by those skilled in the art without departing from the scope and spirit of the invention as set forth in the appended claims. For instance, in the design of the preferred embodiment of the present invention described hereinabove, it may be desirable to treat the arc tube diameter and the cold spot protrusion as independent variables in order to optimize the lamp performance. The arc tube diameter would control the wall loading and the inductive coupling coefficient, whereas the cold spot protrusion would control the halide vapor pressure. This situation would be somewhat analogous to the high pressure sodium design situation, where the bore and cold spot temperature are treated as independent variables. In high pressure sodium, there is an optimum cold spot temperature for each bore. In conventional metal halide practice, on the other hand, it has generally been assumed that the cold spot temperature should be as high as possible. In the preferred embodiment of the present invention the cold spot temperature may, in fact, be somewhat lower than the arc tube wall temperature. In addition the outer jacket design may have an impact on the lamp performance and the cold spot protrusion on lamp life in the preferred embodiment of the present invention.

What we claim as new and desire to secure by the Letters Patent of the United States is:

1. An arc tube for an electrodeless high intensity discharge lamp comprised of:

a light transmissive envelope, a fill material contained in said envelope, an energizing member operatively associated with said envelope to energize said fill material so that during lamp operation a first portion of said fill material forms a discharge while a second portion of the fill material remains on said envelope as a condensate, and a predetermined location on said envelope being effective such that during lamp operation said second portion of said fill material is substantially disposed at said predetermined location.

2. A discharge lamp arc tube as set forth in claim 1 wherein said predetermined location is in the form of at least one local distortion disposed on said envelope and wherein said at least one distortion contains a pocket disposed on said envelope effective such that during lamp operation, said second portion of said fill material is substantially disposed within said pocket.

3. A discharge lamp arc tube as set forth in claim 2 wherein said envelope is essentially spheroidal shaped.

4. A discharge lamp arc tube as set forth in claim 3 wherein said envelope is formed to yield an elongated exhaust tip off with said pocket contained therein.

5. A discharge lamp arc tube as set forth in claim 4 wherein said tip off is disposed on a longitudinal axis of said envelope.

6. A discharge lamp arc tube as set forth in claim 5 wherein the lamp contains a starting aid for said discharge, said starting aid including a tubular member disposed on said envelope and being of a dimension substantially narrower than said envelope, and wherein said lamp further contains an outer jacket disposed in surrounding relation to said envelope, said envelope being connected to said outer jacket via said tubular member in such a manner that said tubular member extends through walls of said outer jacket, said tubular member being effective such that any motion between said envelope and said outer jacket is thereby prevented.

7. A discharge lamp arc tube as set forth in claim 2 wherein said envelope is essentially spheroidal shaped, and is formed to contain said predetermined location defined at least in part by said pocket which is annular and disposed around an equatorial portion of said spheroidal shaped envelope.

8. A discharge lamp arc tube as set forth in claim 2 wherein said envelope is formed to yield an elongated exhaust tip off with said pocket contained therein.

9. A discharge lamp arc tube as set forth in claim 1 wherein said envelope is made of fused quartz material.

10. A discharge lamp arc tube as set forth in claim 1 wherein said energizing member is a Radio Frequency coil disposed in surrounding relation to said envelope.

11. A discharge lamp arc tube as set forth in claim 1 wherein the constituents of said fill materials include a combination of at least one or more metal halides and an inert gas effective as a buffer gas.

12. A discharge lamp arc tube as set forth in claim 11 wherein said fill material constituents are combined in proper weight proportions to achieve the desirable efficacy and color temperature of the light source.

13. A discharge lamp arc tube as set forth in claim 1 wherein said arc tube is spheroidal shaped and has a reflective coating disposed on a first hemisphere thereof for directing light output through a second hemisphere of said arc tube.

14. An arc tube for an electrodeless high intensity discharge lamp comprising:

a light transmissive envelope;

a fill material disposed in the envelope;

an energizing member cooperating with the envelope and fill material disposed therein to energize a first portion of the fill material to a light emissive state while a second portion of the fill material remains on the envelope as a condensate; and means for locating the second portion of the fill material on said envelope during lamp operation.

15. The discharge lamp arc tube as set forth in claim 14 wherein the locating means includes a pocket on said envelope for receiving the condensate during lamp operation.

16. The discharge lamp arc tube as set forth in claim 15 wherein the pocket is defined by an elongated exhaust tip off of the envelope.

17. The discharge lamp arc tube as set forth in claim 15 wherein the envelope is spheroidal shaped and the pocket is defined by an equatorial portion of the envelope.

18. The discharge lamp arc tube as set forth in claim 14 further comprising a reflective coating on at least a portion of the envelope for directing light through an uncoated portion of the envelope.

19. The discharge lamp arc tube as set forth in claim 14 wherein the energizing member includes a Radio Frequency coil disposed in surrounding relation to the envelope.

20. The discharge lamp arc tube as set forth in claim 14 further comprising a starting aid defined by a tubular member disposed on the envelope and being dimensioned substantially narrower than the envelope, and an outer jacket surrounding the envelope and connected thereto to prevent relative motion between the envelope and outer jacket.

* * * * *